US005306472A

United States Patent [19]

Sano et al.

[11] Patent Number: 5,306,472

[45] Date of Patent: Apr. 26, 1994

[54] VACUUM-SUCTION DEGASSING METHOD AND AN APPARATUS THEREFOR

[75] Inventors: Masamichi Sano, Fujimori 1-43-3, Meito-ku, Nagoya-shi, 465, Aichi-ken; Nobuo Miyagawa; Kunji Yamamoto, both of Tajimi, all of Japan

[73] Assignees: Tokyo Yogyo Kabushiki Kaisha, Tokyo; Masamichi Sano, Nagoya, both of Japan

[21] Appl. No.: 58,792

[22] Filed: May 10, 1993

Related U.S. Application Data

[63] Continuation of Ser. No. 715,620, Jun. 14, 1991, abandoned.

[30] Foreign Application Priority Data

Jun. 16, 1990 [JP] Japan ..... 2-158321
Jun. 16, 1990 [JP] Japan ..... 2-158322

[51] Int. Cl.[5] ..... F27D 1/00

[52] U.S. Cl. ..... 422/211; 266/148; 266/149; 266/207; 266/233; 422/199; 422/222; 422/231; 75/405; 95/46; 96/6

[58] Field of Search ..... 422/199, 211, 222, 231, 422/255, 288, 231; 266/148, 149, 207, 208, 233, 235; 55/189, 195, 196; 75/407

[56] References Cited

U.S. PATENT DOCUMENTS 2,809,107 10/1957 Russell .
3,291,596 12/1966 Verge et al. .
3,626,073 12/1971 Sindelar et al. .
4,257,810 3/1981 Narumiya ..... 75/407
4,615,511 10/1986 Sherwood ..... 266/208
4,836,508 6/1989 Fishler .
4,844,425 7/1989 Piras et al. ..... 266/233
4,921,616 5/1990 Minjolle ..... 75/407

FOREIGN PATENT DOCUMENTS 188038 12/1956 Australia .
829777 3/1960 United Kingdom ..... 266/208

*Primary Examiner*—Robert J. Warden
*Assistant Examiner*—Timothy M. McMahon
*Attorney, Agent, or Firm*—Oblon, Spivak, McClelland, Maier & Neustadt

[57] ABSTRACT

A melt is stored in a vessel placed in a decompression vessel. On the bottom of the vessel is arranged a bubble generator made of porous bricks, and bubbles of argon gas are introduced into the melt through this bubble generator. Also a lower half section of a degassing member is immersed in the melt. This degassing member has a cylindrical form with the lower end closed and the section immersed in the melt is made of a porous material permeable to gases and impermeable to melts. With these features, a surface of molten metal can be put under reduced pressure and high content components of the melt can be removed by means of bubbling, and also solute components in the melt can be removed into bubbles of argon gas. Also, gases in the melt and gases produced by reactions between the melt and the porous material can be sucked through a wall of the degassing member into inside thereof and removed.

11 Claims, 3 Drawing Sheets

VACUUM-SUCTION DEGASSING METHOD AND AN APPARATUS THEREFOR

This application is a continuation of application Ser. No. 07/715,620, filed on Jun. 14, 1991, now abandoned.

BACKGROUND OF THE INVENTION

The present invention relates to a vacuum-suction degassing method and an apparatus therefor, in which gas-forming solute ingredients are removed or recovered from a melt, such as a molten metal, matte, or slag, through a porous member.

Conventionally, the RH method, DH method, and other degassing methods are used to remove gas-forming solute ingredients from a molten metal. According to the RH or DH method, a large quantity of argon gas is blown into the melt, the surface of which is kept at a vacuum or at reduced pressure so that the partial pressure of the gas-forming ingredients is lowered, thereby removing these ingredients.

Requiring the use of argon gas in large quantity, however, the conventional RH or DH degassing method entails high running cost. In addition to this defect, the conventional method has a defect that the concentration of gas-forming ingredients in the melt can not be reduced to an extremely low level.

SUMMARY OF THE INVENTION

The object of the present invention is to provide a vacuum-suction degassing method and an apparatus therefor, in which gas-forming ingredients can be easily removed from a melt without using a large quantity of argon gas, so that the melt can be degassed at low cost and the concentration of the ingredients can be reduced to an extremely low level.

A vacuum-suction degassing method according to the present invention, comprises steps of: putting a surface of melt in a vessel under reduced pressure to gasify a part of gas-forming components in said melt; and putting inside of a hollow partitioning member which is made of a porous material permeable to gas and impermeable to melts and immersed in said melt, in vacuum or under reduced pressure, thereby sucking gases in said melt or gases produced by reactions between said melt and components of said partitioning member.

A vacuum-suction degassing apparatus according to the present invention, comprises a vessel containing a melt; depressurizing means for putting a surface of said melt in said vessel under reduced pressure; a bottomed hollow partitioning member made of a porous material permeable to gas and impermeable to melts, said partitioning member being immersed in said melts; and sucking means for sucking gas from said melt or gas produced by a reaction between said melt and said porous member through said partitioning member, in a manner such that the inside of said partitioning member is kept at a vacuum or at a reduced pressure.

Inert gas blowing means for blowing inert gas into said melt in said vessel may be provided.

According to the present invention, a part of high concentration gas-forming components in the melt is removed from the melt by generating boiling of gas in the melt on a surface of the melt in the vessel under reduced pressure. Also, a hollow partitioning member with a bottom made of a porous material permeable to gas, but impermeable to melts is immersed in said melt. The inside of the partitioning member is sucked by said sucking means, thereby the inside of the partitioning member being kept at a vacuum or at reduced pressure. Thus, gases in the melt or gases produced by a reaction between the melt and the porous material, are sucked through the partitioning member. With this, separation of gas-forming components in the melt can be made with an extremely high efficiency, and content of solute components in the melt can be reduced to an extremely low level.

Also, if an inert gas blowing means is arranged, a surface of the melt in the vessel is put under reduced pressure state, gas-forming components in the melt are exhausted to the reduced pressure atmosphere by blowing inert gas into the melt with the inert gas blowing means, and gases produced in the melt and gases produced through reactions between the melt and the porous material are sucked, so that separation of gas-forming components in the melt can be made at an extremely high efficiency and content of solute components in the melt can be reduced to an extremely low level.

In this invention, different from the conventional degassing method blowing a large volume of argon gas, argon gas is not blown, or only a small quantity of argon gas enough to stir the melt is required, so that running cost can be remarkably reduced.

DETAILED DESCRIPTION OF THE PREFERRED EMBODIMENTS

In the method according to the invention, a surface of a melt is put under reduced pressure by, for instance, placing a vessel in which the melt Is stored, under reduced pressure. If content of gas-forming components in the melt is high, when a surface of the melt is put under reduced pressure, gas-forming components are gasified in the melt, and boiling is generated. Thus, gas-forming components can be removed at an extremely high efficiency. In this case, by feeding inert gas such as Ar or $N_2$ into the melt to generate bubbles of the inert gas, efficiency of degasification can be raised more.

In this first process, inside of the porous partitioning member being immersed in the melt is kept under normal pressure to promote boiling.

Then, when content of gas-forming components in the melt is reduced in the above-described first process, after boiling is stopped, inside of the porous partitioning member is evacuated or put under reduced pressure. This partitioning member is made of a porous material which allows permeation of gases but does not allow permeation of melts. For this reason, by putting the inside of this partitioning member in vacuum or under reduced pressure, gas component remaining in said melt or gases produced by reactions between the melt and components of the porous material of the partitioning member pass through the partitioning member and are separated from the melt. With this, content of gas-forming components in the melt can be reduced to an extremely low level.

In an apparatus according to this invention, a depressurizing means puts a surface of the melt in the vessel under reduced pressure. This is realized, for example, by placing a vessel in which a melt is stored in a decompression vessel, and evacuating or reducing pressure in this decompression vessel. In other words, simultaneously when pressure on a surface of molten metal is reduced, inert gas in blown into the melt in the melt vessel by the inert gas blowing means. With this, gas-forming components in the melt are gasified and exhausted from a surface of the melt to atmosphere in the decompression vessel. Also in this invention, a cylindrical partitioning member made of a porous material which allows permeation of gasses but does not allow permeation of melt is immersed in the melt. And, inside of this partitioning member is sucked by a sucking means and kept in vacuum or under reduced pressure. With this, gas-forming components in the melt are exhausted through the partitioning member into inside of the partitioning member.

Thus, in this invention, gas-forming components are exhausted into vacuum or a depressurized atmosphere and are removed from the melt through the partitioning member immersed in the melt. For this reason, degasification of melt can be made at a high efficiency.

Figure 1:
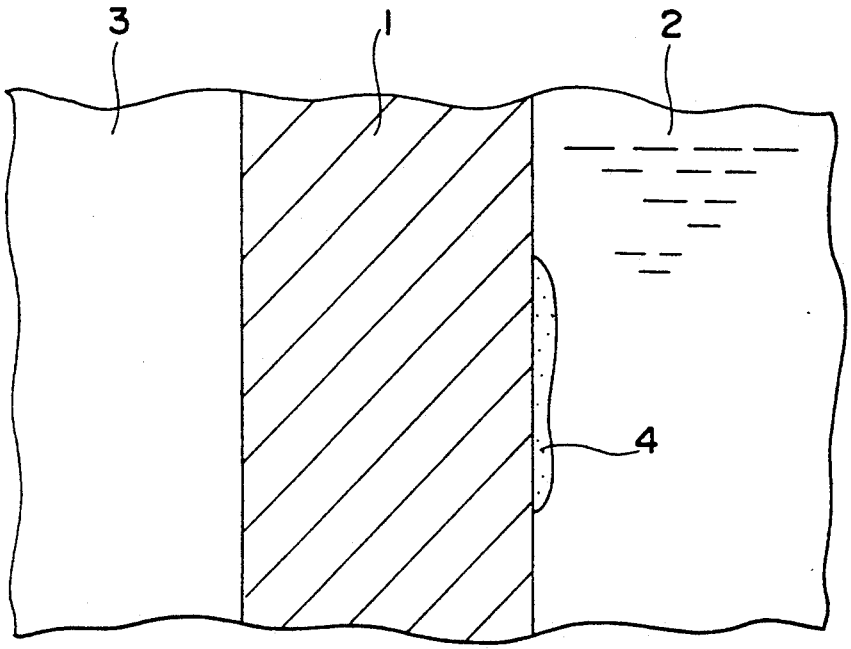
FIG. 1 is a diagram for illustrating the principle of the present invention.

Now, description is made for a principle of this invention with reference to FIG. 1. Melt 2 is stored in a vessel (not shown). Partitioning member I is made of a porous material which is permeable to gas, but impermeable to melts, such as molten metal, molten matte, or molten slag, and is formed into a cylindrical form with a bottom. This partitioning member 1 performs such movements as rotation or vibration being driven by a drive device (not shown) and moves in the melt 2 to stir the melt 2.

In this case, if space 3 inside partitioning member 1 is kept at a vacuum or at reduced pressure 3, the pressure on the wall surface in contact with the melt drops without regard to the static pressure of the melt 2.

Accordingly, those impurities or valuables in melt 2 which produce gaseous substances easily nucleate on the wall surface of porous member 1 to form gas 4, and resulting gas 4 permeates through member 1 and sucked into space 3 at vacuum or reduced pressure atmosphere so that the impurities or valuables are removed from the melt and recovered into space 3 at vacuum or reduced pressure atmosphere.

The inventor hereof realized that gas-forming ingredients can be removed from the melt on the basis of the principle described above, and brought the present invention to completion.

The gas-forming ingredients dissolved in the melt are sucked and removed in the form of gases as follows:

$$N+N=N_2 \quad (1)$$

$$H+H=H_2 \quad (2)$$

$$C+O=CO \quad (3)$$

$$S+2O=SO_2 \quad (4)$$

The impurities in the melt may react with the ingredients of the porous member, to form gases, and then they may be removed through the porous member.

If the porous member is an oxide ($M_XO_Y$), carbon in the melt is removed in the form of a gas as follows:

$$yC+M_XO_Y\,(\text{solid})=xM+yCO \quad (5)$$

If the porous member contains carbon, moreover, oxygen in the melt is sucked and removed according to the following reaction formula.

$$O+C\,(\text{solid})=CO \quad (6)$$

The separative recovery of a valuable component (M) which has high vapor pressure is achieved by gasifying the valuable component according to the following reaction formulas.

$$xM=M_X\,(\text{gas}) \quad (7)$$

$$MO_Y=MO_Y\,(\text{gas}) \quad (8)$$

$$MS_Y=MS_Y\,(\text{gas}) \quad (9)$$

In this manner, the impurities, such as N, H, C, 0, and S, and the valuable components are sucked and removed or recovered from the melt.

In this invention, by adjusting content of components of the partitioning member which react with the impurities or valuable components in a melt, it is possible to control a reaction rate between the impurities or valuable components in the melt and components of the partitioning member.

Note that a heating means may be added to heat a partitioning member or a melt by energizing the partitioning member or burying a resistance wire previously in the partitioning member and energizing the resistance wire, or by heating the melt from outside by means of, for instance, plasma heating), for the purpose to prevent the decrease of temperature of the melt due to heat emission to atmosphere or the vessel or the decrease of temperature of the melt which occurs when the partitioning member is immersed into the melt, or decrease of temperature of the melt due to an endothermic reaction between components of the partitioning member and the melt.

Various materials may be used for porous member, including metal oxides or other metallic compounds (non-oxides), carbon and mixtures thereof and metal, such as $Al_2O_3$, MgO, CaO, $SiO_2$, $Fe_2O_3$, $Fe_3O_4$, $Cr_2O_3$, BN, $Si_3N_4$, SiC, C, etc. Preferably, the material used should not react with the principal ingredient of melt 2 so that porous member in contact with melt 2 can be prevented from erosion loss and melt 2 can be kept clean.

Also, a material which hardly gets wet with melts must be used for the partitioning member so that only gases can pass through the partitioning member but any melts can not pass through the partitioning member. Furthermore, it is preferable that a porosity of the partitioning member is not more than 40% and its diameter is about 200 μm or less.

Furthermore, in order to prevent a melt from entering the vacuum system even if a melt goes into the immersed porous tube, it is preferable to allocate a filter with small pressure loss in an upper section of the immersed porous tube to solidify the invading melt for trapping it.

The following is a description of a case in which the present invention is applied to the removal or recovery of gas-forming ingredients from a melt.

(1) First, the present invention can be applied to decarburization, denitrogenation, and dehydrogenation processes for removing carbon, nitrogen, or hydrogen from molten iron.

When this method is applied to remove carbon from molten iron, the main component of said partitioning member should be $Al_2O_3$ or MgO, and such a material as $Fe_2O_3$, $Fe_3O_4$, MnO, and $SiO_2$ etc. should be mixed in as main oxidizing agents for carbon in the molten iron. But if a compounding ratio of the main oxidizing agent is too high, a melting point of the partitioning member goes down, or the mechanical strength thereof becomes lower, and if carbon content in the molten iron is too low, oxygen content in the molten iron goes up, so that a compounding ratio of the main oxidizing agent must be decided according to the purpose and by referring to the phase diagram already established.

On the other hand, if this method is applied to removal of nitrogen in molten iron, a stable oxide such as CaO, $Al_2O_3$, or MgO should be used as said partitioning member.

Also, if this invention is applied to simultaneous removal of carbon and nitrogen in molten iron, the compounding ratio of the oxidizing agent should be changed according to target contents of carbon and nitrogen in the molten iron.

(2) The invention can be also applied to a deoxygenation process for removing oxygen from molten copper.

(3) Further, the invention can be applied to a dehydrogenation process for removing hydrogen from molten aluminum.

(4) Furthermore, the invention can be applied to decarburization, and dehydrogenation of molten silicon.

(5) According to the present invention, zinc can be recovered from molten lead.

(6) The invention can be also applied to a desulfurization/deoxygenation process for removing sulfur and oxygen from molten copper matte.

(7) Further, the invention can be applied to the recovery of valuable metals (As, Sb, Bi, Se, Te, Pb, Cd, etc.) from molten copper matte or nickel matte.

(8) Furthermore, the invention can be applied to the recovery of valuable metals (As, Sb, Bi, Se, Te, Pb, Cd, Zn, etc.) from slag.

Detailed description is made below for embodiments of this invention. Melt 2 Is stored in vessel 5, and vessel 5 is placed in decompression vessel 10. At the bottom of vessel 5 is arranged bubble generator 9 made of porous bricks, and inert gas such as Ar gas is supplied though pipe 8*b* to this bubble generator 9. By loading inert gas pressure equal to static pressure of melt 2, leak of melt 2 through bubble generator 9 is prevented and melt 2 can be maintained in vessel 5, and at the same time the inert gas is not blown into melt 2. If pressure more than the static pressure of melt 2 is loaded to bubble generator 9, bubbles of the inert gas are introduced from bubble generator 9 to melt 2. Note that decompression vessel 10 is connected to a vacuum suction pump (not shown) to keep inside of the decompression vessel in vacuum or in a reduced pressure atmospheric state.

The lower half section of degassing member 6 is immersed in melt 2. This degassing member has a cylindrical form with the lower end closed. The lower half section which is immersed in melt 2 is made of a material having pores which is permeable to gases but impermeable to melts, such as molten metal, molten slag or molten matte. The lower half section of this degassing member 6, which is made of a porous material, is partitioning member 6*a*. Also, the upper half section of degassing member 6 is made of a non-porous material member which does not allow permeation of gases. This partitioning member 6*a* and the non-porous member 6*b* may be made separately and joined together thereafter, or the entire degassing member 6 may be made using a porous material first and the upper half portion may be, for instance, coated with a non-porous material so that any gas can not pass therethrough.

On a top end of non-porous member 6*b* which is exposed over melt 2 and does not allow permeation of gases is fixed link member 7, and additionally pipe 8*a* is linked to a vacuum pump (not shown) so that said pipe 8*a* communicates with degassing member 6.

In the vacuum suction degassing apparatus thus constructed, inside of decompression vessel 10 is put in a depressurized atmospheric state, and bubbles are generated in melt 2 by feeding inert gas such as Ar gas. Also, inside of degassing member 6 is sucked through pipe 8*a* by a vacuum pump to keep the inside of degassing member 6 in vacuum or under reduced pressure.

With this, gas-forming components in melt 2 are exhausted together with bubbles of the inert gas into depressurized atmosphere inside the decompression vessel, and also pass through partitioning member 6*a* of degassing member 6 to inside of degassing member 6, and removed through pipe 8*a*.

Thus, gas-forming components in melt 2 are exhausted into depressurized atmosphere in the decompression vessel 10 and are removed from melt 2 through partitioning member 6*a* made of porous material, so that a degassing speed of melt 2 is high and content of gas-forming components in the melt can be reduced to an extremely low level. Also, as a quantity of inert gas may be small only enough to stir melt 2, the running cost is low.

Note that a timing to reduce pressure in decompression vessel 10, a timing to supply argon gas, and a timing to suck inside of the degassing member 6 may not coincide with each other. Bubbling on a surface of the molten metal may be promoted under reduced pressure first, and then inside of degassing member 6 may be evacuated, and other patterns for each timing are allowable.

Figure 2:
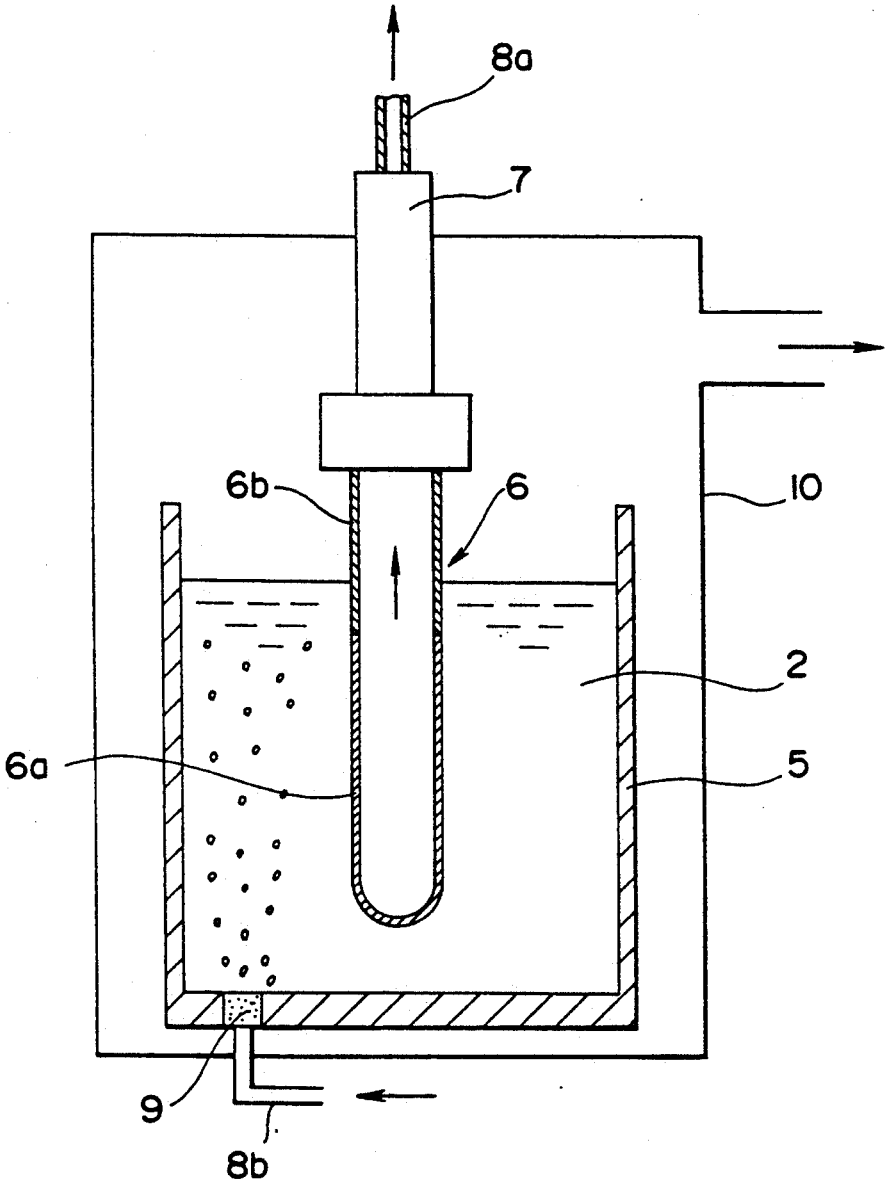
FIG. 2 is a schematic cross-sectional view showing a first embodiment of the invention.
Figure 3:
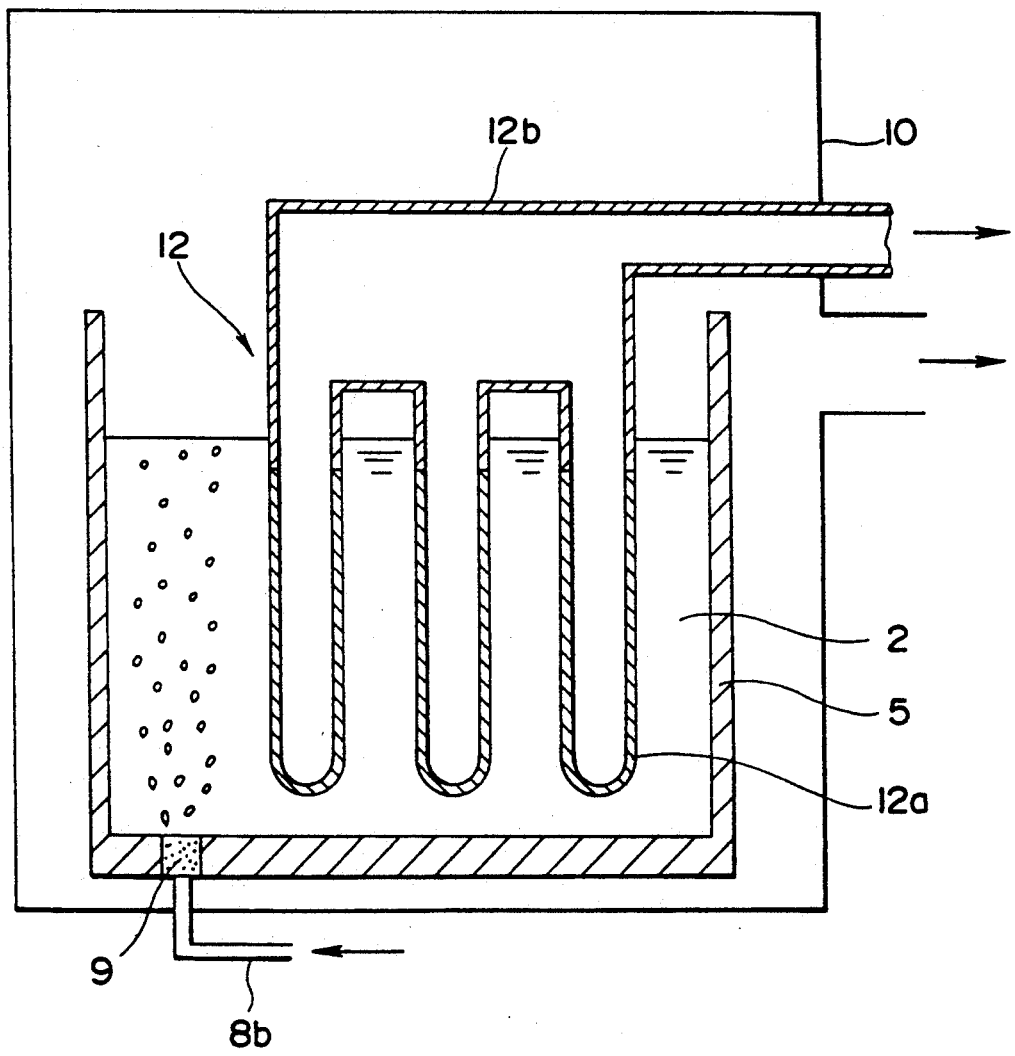
FIG. 3 is a schematic cross-sectional view showing a second embodiment of the invention.

FIG. 3 is a schematic cross-sectional view showing an apparatus according to the second embodiment of this invention. This embodiment is different from the first embodiment in the form of degassing member thereof, and other portion of the configuration is basically the same as the first embodiment, so that the same code in FIG. 2 is used for the same items in FIG. 3 and detailed description thereof is omitted.

Degassing member 12 comprised a plurality of cylindrical form of partitioning members 12 with a bottom respectively (3 pieces in FIG. 3) and housing 12*b* linked to partitioning members 12*a*. Degassing member 12 is linked to a vacuum pump (not shown), and the inside is sucked by the vacuum pump to keep it in vacuum or under reduced pressure.

In this embodiment, as a contact area between porous partitioning member 12*a* made of a porous material and melt 2 is large, the efficiency to remove gas-forming components from melt 2 is higher than that in the first embodiment.

What is claimed is:

1. A vacuum-suction degassing method comprising the steps of:

placing a melt of molten metal, matte or slag in a vessel under reduced atmospheric pressure to gasify a part of gas-forming components in said melt; and immersing a hollow partitioning member in said melt which is made of a porous material permeable to gas and impermeable to the melt under reduced atmospheric pressure, said porous material having a chemical composition which chemically reacts with an impurity in said melt to yield a product gas, whereby suction permeation of gas in said melt and said product gas produced by chemical reaction is effected through said porous member.

2. The vacuum-suction degassing method according to claim 1, wherein said partitioning member is electrically heated.

3. The vacuum-suction degassing method according to claim 1, wherein said porous material is a material selected from the group consisting of:

$Al_2O_3$, MgO, CaO, $SiO_2$, $Fe_2O_3$, $Fe_3O_4$, $Cr_2O_3$, BN, $Si_3N_4$, SiC and C.

4. A vacuum-suction degassing apparatus according to claim 1, wherein said porous material is an oxide having the formula $M_XO_Y$ and the impurity is carbon, said impurity being removed according to the formula:

$$yC+M_XO_Y\,(\text{solid})=xM+yCO.$$

5. The vacuum-suction degassing apparatus according to claim 1, wherein said porous member contains carbon, wherein said impurity is oxygen, and said impurity is removed according to the formula:

$$O+C\,(\text{solid})=CO.$$

6. A vacuum-suction degassing apparatus comprising:

a vessel containing a melt of molten metal, matte or slag;

a depressurizing means for reducing the surface of said melt in said vessel below atmospheric pressure;

an inert gas blowing means for blowing inert gas into said melt in said vessel;

a hollow partitioning member having a bottom formed of a porous member material permeable to gas and impermeable to melts, said porous material having a chemical composition which chemically reacts with an impurity in said melt to yield a product gas, said partitioning member being immersed in said melt; and suction means connected to said partitioning member for sucking gas from said melt or said product gas, keeping the inside of said partitioning member at a pressure less than atmospheric pressure so that suction permeation of said gas from melt or said product gas through said porous member is effected.

7. The vacuum-suction degassing apparatus according to claim 6, comprising inert gas blowing means for blowing inert gas into said melt in said vessel.

8. The vacuum-suction degassing apparatus according to claim 6, comprising heating means for electrically heating said partitioning member.

9. The vacuum-suction degassing apparatus according to claim 6, wherein said porous material is a material selected from the group consisting of:

$Al_2O_3$, MgO, CaO, $SiO_2$, $Fe_2O_3$, $Fe_3O_4$, $Cr_2O_3$, BN, $Si_3N_4$, SiC and C.

10. A vacuum-suction degassing apparatus according to claim 6, wherein said porous material is an oxide having the formula $M_XO_Y$ and the impurity is carbon, said impurity being removed according to the formula:

$$yC+M_XO_Y\,(\text{solid})=xM+yCO.$$

11. The vacuum-suction degassing apparatus according to claim 6, wherein said porous member contains carbon, wherein said impurity is oxygen, and said impurity is removed according to the formula:

$$O+C\,(\text{solid})=CO.$$

* * * * *